US009472861B2

(12) United States Patent
Bi et al.

(10) Patent No.: US 9,472,861 B2
(45) Date of Patent: Oct. 18, 2016

(54) MULTI-MODE ANTENNA AND BASE STATION

(71) Applicant: China Telecom Corporation Limited, Beijing (CN)

(72) Inventors: Qi Bi, Morris Plains, NJ (US); Weiliang Xie, Beijing (CN)

(73) Assignee: China Telecom Corporation Limited, Beijing (CN)

( * ) Notice: Subject to any disclaimer, the term of this patent is extended or adjusted under 35 U.S.C. 154(b) by 290 days.

(21) Appl. No.: 14/168,215

(22) Filed: Jan. 30, 2014

(65) Prior Publication Data

US 2014/0145896 A1 May 29, 2014

Related U.S. Application Data

(63) Continuation of application No. PCT/CN2012/079667, filed on Aug. 3, 2012.

(30) Foreign Application Priority Data

Aug. 4, 2011 (CN) ..... 2011 1 0221717

(51) Int. Cl.
*H01Q 21/24* (2006.01)
*H01Q 5/42* (2015.01)
(Continued)

(52) U.S. Cl.
CPC ..... *H01Q 21/24* (2013.01); *H01Q 1/246* (2013.01); *H01Q 5/42* (2015.01); *H01Q 21/08* (2013.01); *H01Q 21/28* (2013.01); *H01Q 25/04* (2013.01)

(58) Field of Classification Search
None
See application file for complete search history.

(56) References Cited

U.S. PATENT DOCUMENTS 5,757,324 A 5/1998 Helms et al.
6,211,841 B1 * 4/2001 Smith ..... H01Q 1/246 343/797

(Continued)

FOREIGN PATENT DOCUMENTS

CN 201430217 Y 3/2010
CN 101826662 A 9/2010

(Continued)

OTHER PUBLICATIONS

Supplementary European Search Report mailed Mar. 5, 2015 in EP 12819940, 5 pages.

(Continued)

*Primary Examiner* — Robert Karacsony
(74) *Attorney, Agent, or Firm* — Kilpatrick Townsend & Stockton LLP

(57) ABSTRACT

This invention discloses a multi-mode antenna and a base station, the multi-mode antenna comprising a CDMA dual-polarized antenna for CDMA radio frequency signals and two MIMO dual-polarized antennas for LTE radio frequency signals with a plurality of linearly arranged radiation elements; the two MIMO dual-polarized antennas are respectfully vertically stacked right above and right below the center radiation element of the CDMA dual-polarized antenna; and the radiation elements in the two MIMO dual-polarized antennas are nested in or inserted between the radiation elements of the CDMA dual-polarized antenna according to the distance between the radiation elements of the CDMA dual-polarized antenna and the distance between the radiation elements of each MIMO dual-polarized antenna. The present invention combines the technologies of nested antenna radiation elements and vertical isolation separation of MIMO antennas so as to integrate a CDMA dual-polarized antenna and two MIMO dual-polarized antennas into one physical antenna.

14 Claims, 1 Drawing Sheet

(51) Int. Cl.

| | |
|---|---|
| ***H01Q 21/08*** | (2006.01) |
| ***H01Q 21/28*** | (2006.01) |
| ***H01Q 1/24*** | (2006.01) |
| ***H01Q 25/04*** | (2006.01) |

(56) References Cited

U.S. PATENT DOCUMENTS

| | | | | |
|---|---|---|---|---|
| 2009/0135078 | A1* | 5/2009 | Lindmark | H01Q 1/523 343/844 |
| 2010/0227647 | A1* | 9/2010 | Shimizu | H01Q 1/246 455/562.1 |
| 2011/0148730 | A1 | 6/2011 | Gottl | |

FOREIGN PATENT DOCUMENTS

| | | | |
|---|---|---|---|
| CN | 102013560 | A | 4/2011 |
| CN | 102110878 | A | 6/2011 |
| CN | 102136634 | A | 7/2011 |
| EP | 0820116 | A2 | 1/1998 |
| EP | 1227545 | A1 | 7/2002 |
| EP | 1353405 | A1 | 10/2003 |
| JP | H11510662 | A | 9/1999 |
| JP | 2010233214 | A | 10/2010 |
| JP | 2011030189 | A | 2/2011 |
| WO | 2007/011295 | A1 | 1/2007 |
| WO | 2007011295 | A1 | 1/2007 |

OTHER PUBLICATIONS

International Search Report mailed Nov. 1, 2012 in PCT/CN2012/079667, 2 pages.

Du, Jiu-Hui, et al., "HSDPA capacity of TDD-CDMA systems with smart antennas," Feb. 2008, Journal of Circuits and Systems, vol. 13, No. 1, 5 pages including 1-page English Abstract at end of document.

Li, Lingjian, et al., "High Efficiency LTE Band Base Station Antenna Array for MIMO System Evaluation," 2010 Loughborough Antennas & Propagation Conference, Nov. 8-9, 2010, Loughborough, UK, 4 pages.

English translation of Office Action mailed Feb. 25, 2016 in JP Patent Application 2014-523191. 2 pages.

* cited by examiner

MULTI-MODE ANTENNA AND BASE STATION

CROSS-REFERENCE TO RELATED APPLICATIONS

This application is a Continuation of International Application No. PCT/CN2012/079667, International Filing Date Aug. 3, 2012, and which claims the benefit of Chinese Patent Application No. 201110221717.5, filed on Aug. 4, 2011 and entitled "Multi-Mode Antenna and Base Station", the disclosures of all applications being incorporated herein by reference.

BACKGROUND

1. Field of the Invention

The present invention relates to the field of mobile communication technology, and more particular, to a multi-mode antenna and a base station.

2. Description of the Related Art

Currently, mobile communication networks have developed to the three generation (3G), and 3G networks have been deployed and used widely in the world. With the continuous popularization and promotion of data services and mobile internet, the International Mobile Standards Organization has developed Long Time Evolution (LTE) and 4G technical standards to meet the increasing development of network technology and service capability. Because the Multiple-Input and Multiple-Output (MIMO) technique may greatly improve the network service rate and link performance due to its sufficient use of independent spatial propagation paths, and has become one of the core techniques of LTE and future 4G technology.

For a mobile networks operator, in order to keep the continuity of old services and to provide new networks and new services, it is required to deploy and establish multiple mobile network systems at the same time. Particularly, because a LTE system adopts MIMO antennas, the network itself has a large number of antennas, along with original 2G and 3G system antennas, the number of antennas on the roof of a base station will become much higher than that of a current site location. In addition, most of current 2G and 3G networks utilize low frequency resources, for example, the 900 MHz band used by GSM, the 800 MHz band used by CDMA, and LTE and future 4G may likely use frequency bands above 2 GHz, for example, the 2 GHz or 2.6 GHz band. Because there is a huge frequency gap between the 800/900 MHz 2G systems and 2/2.6 GHz LTE systems, it is very difficult to realize a wide frequency antenna supporting several frequency bands simultaneously, and thereby it is impossible to reduce the number of antennas for future multiple system coexistence by using wide frequency antenna techniques. Further, with the increase in the number of antennas, there may be a situation of unable to add further antennas due to insufficient roof space of a site location.

Thus, how to reduce the number of physical antennas while meeting the requirement of network infrastructure establishment is a problem desired to be solved by mobile operators.

SUMMARY

A technical problem to be solved by this invention is to provide a multi-mode antenna and a base station, capable of reducing the number of physical antennas while supporting multiple systems.

According to an aspect of this invention, a multi-mode antenna is provided, comprising a CDMA dual-polarized antenna consisting of a plurality of linearly arranged radiation elements and used for receiving and transmitting a radio frequency signal in a CDMA system; and two MIMO dual-polarized antennas each consisting of a plurality of linearly arranged radiation elements and used for receiving and transmitting a radio frequency signal in an LTE system; wherein one of the two MIMO dual-polarized antennas is stacked in the vertical direction right above the centre radiation element of the CDMA dual-polarized antenna and the other of the two MIMO dual-polarized antennas is stacked in the vertical direction right below the centre radiation element of the CDMA dual-polarized antenna; and the radiation elements in the two MIMO dual-polarized antennas are nested in the radiation elements of the CDMA dual-polarized antenna or inserted between the radiation elements of the CDMA dual-polarized antenna according to the distance between the radiation elements of the CDMA dual-polarized antenna and the distance between the radiation elements of each MIMO dual-polarized antenna.

According to another aspect of this invention, a base station is further provided, comprising the multi-mode antenna of the above embodiment.

With the multi-mode antenna and base station provided in this disclosure, through a combination of the nested antenna radiation element technology and the vertical separation MIMO antenna technology, a CDMA dual-polarized antenna and two MIMO dual-polarized antennas may be integrated into one physical antenna, which may support a 2*2 diversity receiving/transmitting system in a CDMA network and a 4*4 MIMO configuration in a LTE system simultaneously, to facilitate the development of a LTE MIMO system and lower network operation cost, with improved convenience.

BRIEF DESCRIPTION OF THE DRAWINGS

The accompany drawings, which forms part of this application, are provided for a further understanding of this invention, in which.

DESCRIPTION OF THE EMBODIMENTS

A further complete description of the present invention will be given below with reference to drawings, wherein embodiments of the present invention will be described. Exemplary embodiments of the present invention and their illustration are used to explain the present invention and are not limitations thereof.

The description of at least one exemplary embodiment below is merely illustrative in nature, and is by no means any limitations to the applications or use of the present invention.

Figure 1:
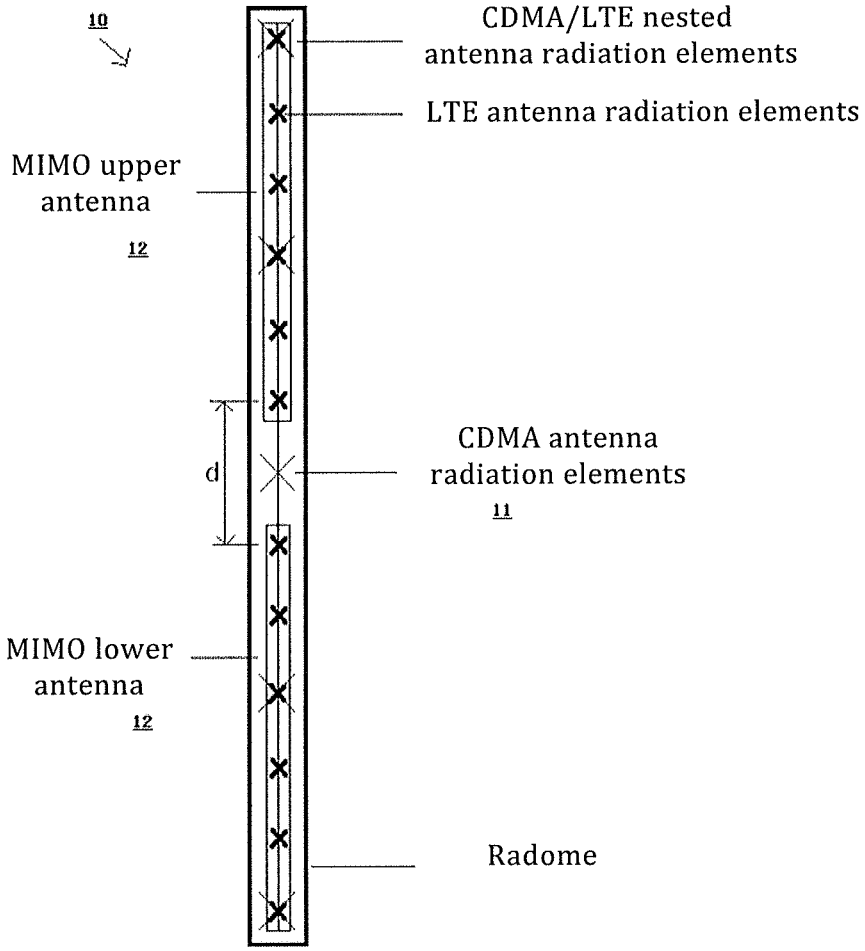
FIG. 1 is a schematic diagram of the structure of a multi-mode antenna according to an embodiment of this invention.

The MIMO antenna configuration used in a LTE system generally comprises 2*2, 4*2, 4*4 (i.e., the number of transmitting antennas*the number of receiving antennas), etc., thus a base station needs a plurality of antennas for receiving and transmitting signals. Currently, a prevalent 2*2 antenna design scheme generally utilizes dual-polarized antennas to meet its requirements. Because dual-polarized antennas have weak correlation between two polarization directions, they may meet the design requirements of 2*2 MIMO antennas. As regard to 4*2 and 4*4 MIMO antennas, a base station needs to deploy four antennas. This disclosure provides a MIMO antennas implementation scheme of a combination of dual polarization and vertical separation, in which two dual-polarized antennas are vertically stacked as shown in FIG. 1, such that vertical separation is constructed between the upper and lower antennas, and finally four MIMO antennas with weak spatial correlation are formed to guarantee the performance of the 4*2 and 4*4 MIMO antenna. Because of the vertical separation provided, only the length of the antenna is increased and no additional roof space is required for the base station, while making it easy to guarantee the consistency of tilt angles of the upper and lower antennas (i.e., the angle of the antenna with respect to its pole). In MIMO, the downtilt angles of various antennas must be kept consistent as much as possible. If vertical isolation is adopted, it is very easy to keep the downtilt angles of various antennas consistent, because they are adjusted with respect to the same pole; if horizontal separation is adopted, the two antennas are mounted on two poles separately, which may cause errors between the two poles, and thus inconsistency of antenna downtilt angles.

For CDMA systems, a current prevalent antenna configuration comprises one dual-polarized antenna for diversity receiving and transmitting of CDMA systems. For the integration of four MIMO and a CDMA dual-polarized antenna, conventionally, wide frequency antennas are adopted to support receiving and transmitting of systems with different frequency bands. However, because there is a larger gap between the 800 MHz CDMA system frequency and 2/2.6 GHz LTE system frequency, it is very difficult to adopt wide frequency antenna schemes, and it is difficult to guarantee that antenna radiation performance requirements may be met for both the 800 MHz and 2/2.6 GHz frequency bands simultaneously.

Because the MIMO technique adopted for LTE networks may greatly increase the number of antennas on a base station site location, based on the nested antenna radiation element technique and the vertical separation technique adopted by dual-band antennas, the present disclosure provides a multi-mode antenna design method, particularly as follows.

(1) Based on the central frequencies used in CDMA and LTE systems, according to the principle that the distance between antenna radiation elements is $0.7\lambda \sim 1\lambda$, calculate and design a distance between radiation elements of the CDMA and LTE antenna systems, obtain the number of independent LTE antenna radiation elements that may be inserted between two CDMA/LTE nested oscillators;

(2) According to the CDMA and LTE antenna radiation element distance designed at step (1), based on antenna gains required by the CDMA and LTE systems respectively, obtain total numbers of antenna radiation elements required by the CDMA antenna and the upper and lower LTE MIMO antennas;

(3) According to the number of CDMA antenna radiation elements obtained at step (2), first, arrange CDMA antenna radiation elements vertically, and then according to the number of independent LTE antenna radiation elements that may inserted between two CDMA radiation elements obtained at step (1), insert independent LTE antenna radiation elements between CDMA antenna radiation elements;

(4) Given that the number of CDMA antenna radiation elements is an odd number, taking the middle CDMA antenna radiation element as a centre, design the upper and lower CDMA radiation elements as CDMA/LTE nested antenna radiation elements, until the total number of the CDMA/LTE nested antenna radiation elements and independent LTE antenna radiation elements goes beyond the total number of antenna radiation elements required by the upper and lower MIMO antennas;

(5) Given that the number of CDMA antenna radiation elements is an even number, taking any one of two middle CDMA antenna radiation elements as a centre, design the upper and lower CDMA radiation elements as CDMA/LTE nested antenna radiation elements, until the total number of the CDMA/LTE nested antenna radiation elements and independent LTE antenna radiation elements goes beyond the total number of antenna radiation elements required by the upper and lower MIMO antennas;

(6) Design LTE antenna radiation elements above and below the CDMA antenna centre radiation element as upper and lower MIMO antennas that are vertically separated;

(7) The CDMA antenna radiation elements utilize a separate electrical adjustment system, and the upper and lower LTE MIMO antennas utilize another separate electrical adjustment system together; the two electrical adjustment systems control the electrical downtilt angles of the CDMA and LTE antennas separately.

According to the above design method, a CDMA/LTE coexistent multi-mode antenna structure shown in the below embodiment may be developed, particularly as follows.

FIG. 1 is a structural schematic diagram of a multi-mode antenna according to an embodiment of this invention.

As shown in FIG. 1, the multi-mode antenna 10 of this embodiment may comprise:

A CDMA dual-polarized antenna 11 consisting of a plurality of linearly arranged radiation elements for receiving and transmitting a radio frequency signal in a CDMA system, and forming receiving diversity and transmitting diversity of the CDMA system;

Two MIMO dual-polarized antenna 12 each consisting of a plurality of linearly arranged radiation elements and used for receiving and transmitting the radio frequency signal in an LTE system; as shown in FIG. 1, the upper MIMO dual-polarized antenna radiation elements construct a MIMO dual-polarized antenna, the lower MIMO dual-polarized antenna radiation elements construct another MIMO dual-polarized antenna, the two upper and lower MIMO dual-polarized antennas form four MIMO antennas to realize a downlink 4*2 or 4*4 LTE MIMO system configuration;

Wherein, one of the two MIMO dual-polarized antennas is stacked in the vertical direction right above the centre radiation element of the CDMA dual-polarized antenna and the other of the two MIMO dual-polarized antennas is stacked in the vertical direction right below the centre radiation element of the CDMA dual-polarized antenna. According to the radiation element distance of the CDMA dual-polarized antenna and the radiation element distance of each MIMO dual-polarized antenna, radiation elements of the two MIMO dual-polarized antennas are nested (the nested antenna radiation element technique as high frequency antenna radiation elements and low frequency antenna radiation elements nested together, because high frequency antenna radiation elements are smaller than low frequency antenna radiation elements in size, it appears that a high frequency antenna radiation element is disposed at the centre of a low frequency antenna radiation element with their central positions overlapped) in the radiation elements of the CDMA dual-polarized antenna or inserted between the radiation elements of the CDMA dual-polarized antenna. As shown in FIG. 1, some of the MIMO dual-polarized antenna radiation elements are nested in CDMA dual-polarized antenna radiation elements, and other MIMO dual-polarized antenna radiation elements are located between two CDMA dual-polarized antenna radiation elements.

This embodiment combines the nested antenna radiation element technique and the vertical MIMO antenna technique to enable the integration of a CDMA dual-polarized antenna and two MIMO dual-polarized antennas into the same physical antenna radome, while supporting a 2*2 diversity receiving and transmitting system of the CDMA network and a 4*4 MIMO configuration of the LTE system, which is beneficial to the deployment of a LTE MIMO system and decrease network operation cost with improved convenience.

In one embodiment, in order to provide low spatial channel cross correlation and high port isolation between the upper and lower MIMO antennas (generally, it is required to meet isolation between antenna ports of about 30 dB), the distance between the lowest radiation element in the MIMO dual-polarized antenna right above the centre radiation element of the CDMA dual-polarized antenna and the top radiation element in the MIMO dual-polarized antenna right below the centre radiation element of the CDMA dual-polarized antenna may be set to above 0.5λ1, wherein, λ1 is the wavelength of a center frequency supported by the LTE MIMO dual-polarized antenna. According to the restriction on antenna length, the distance may be further set to 0.5λ1~2λ1, preferably, 0.7λ1~1λ1, to meet the isolation requirement without increasing the length of the antenna.

Due to the restriction on the length of the radius of the antenna radiation element (0.5 wavelength), if the vertical separation distance is set to 0.5 wavelength, serious cross coupling may occur between antenna radiation elements, as a result, radiation efficiency of various radiation elements may be reduced, and the gain of the whole antenna may be reduced as well. Thus, 0.7~1 wavelength that is slightly larger than 0.5 wavelength is selected to substantially eliminate cross coupling between antenna radiation elements. However, too large vertical separation distance (for example, 4-7 times wavelength) may cause larger antenna side lobes, lower antenna gain, too large antenna length, and then may improve the stability requirement of the antenna pole, increasing project implementation cost and difficulty.

Also as shown in FIG. 1, radiation elements of the CDMA dual-polarized antenna and the two MIMO dual-polarized antennas are all ±45 degrees polarized, and the numbers of radiation elements of the CDMA dual-polarized antenna and the two MIMO dual-polarized antennas are determined by their gains. Radiation elements of the CDMA dual-polarized antenna have the same distance there between, generally 0.7λ2~1λ2, wherein λ2 is the wavelength of a center frequency supported by the CDMA dual-polarized antenna. Similarly, radiation elements of the MIMO dual-polarized antenna have the same distance there between, generally 0.71λ1~1λ1, because the CDMA system and the LTE system adopt different frequencies, λ2 of the CDMA system is different with λ1 of the LTE system, causing that the CDMA dual polarization radiation element distance is different from the MIMO dual polarization radiation element distance. Further, because CDMA uses lower frequencies, the CDMA antenna radiation element distance is larger than the LTE MIMO antenna radiation element distance.

Because a nested antenna radiation element technique is adopted in this disclosure to realize the integration of CDMA and LTE MIMO antennas, it is necessary to take requirements of two systems into account when designing CDMA and MIMO antenna radiation element distances. For the convenience of description, the center frequency of the CDMA system is set to 850 MHz as an example, and there are two scenarios of the center frequency of the LTE system, i.e., 2 GHz and 2.6 GHz respectively.

Figure 2:
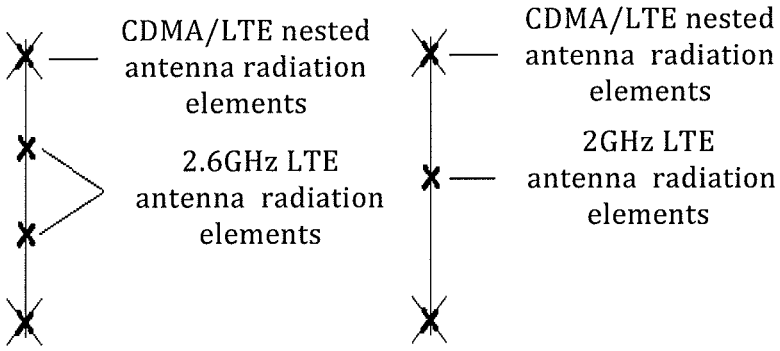
FIG. 2 is a schematic diagram of the designed distance between antenna radiation elements of an embodiment this invention.

First, a scenario of 2 GHz center frequency of the LTE system will be analyzed. According to the design range 0.7λ~1λ of antenna radiation element distances, it may be obtained that the CDMA antenna radiation element distance is 247 mm~353 mm, and the LTE antenna radiation element distance is 105 mm~150 mm. As seen from the selection ranges of antenna radiation elements of the two systems, there may be various schemes available, for example, the CDMA antenna radiation element distance is 300 mm, and the LTE antenna radiation element distance is 150 mm. However, generally only one independent LTE antenna radiation element may be inserted between two CDMA antenna radiation elements as shown in FIG. 2.

Next, a scenario of 2.6 GHz center frequency of the LTE system will be analyzed. According to the design range 0.7λ~1λ of antenna radiation element distances, it may be obtained that the CDMA antenna radiation element distance is 247 mm~353 mm, and the LTE antenna radiation element distance is 81 mm~115 mm. As seen from the selection ranges of antenna radiation elements of the two systems, generally two independent LTE antenna radiation elements are inserted between two CDMA antenna radiation elements, for example, the CDMA antenna radiation element distance may be set to 300 mm, and the LTE antenna radiation element distance is 100 mm, as shown in FIG. 2.

The above analysis of antenna radiation element distance is merely illustrative. In a practical antenna design process, a flexible design may be made particularly according to a frequency used and the principle of an antenna radiation element distance of 0.7λ~1λ.

In the case that the number of radiation elements of the CDMA dual-polarized antenna is an odd, a middle antenna radiation element is taken as a centre radiation element. In the case that the number of radiation elements of the CDMA dual-polarized antenna is an even, any one of two middle antenna radiation elements is taken as a centre radiation element to ensure the symmetry of upper and lower MIMO antennas.

Because a CDMA antenna and LTE MIMO antennas are integrated into a physical antenna in this disclosure, the two systems may hold the same mechanical downtilt angle. In order to enable the two systems to select different antenna tilt angles, the CDMA and LTE antennas adopt a separate electrical adjustment scheme in this invention to separately control electrical down tilt angles for the CDMA dual-polarized antenna and the two MIMO dual-polarized antennas.

In this disclosure, the CDMA dual-polarized antenna and the two MIMO dual-polarized antennas are encapsulated into one radome to ensure a high integration level and a small volume of the antenna, which is favourable to network operators' actual network deployments and may make base station site selection convenient. At the same time, integration may also bring about great convenience for antenna mounting.

Further, according to a configuration requirement of MIMO antennas of the LTE system, for example, 8*8, two other upper and lower MIMO dual-polarized antennas may be provided left or right to the antenna shown in FIG. 1 to realize better transmitting diversity/receiving diversity.

Further, the multi-mode antenna of this disclosure is applicable to a CDMA/LTE co-site base station.

Although some specific embodiments of the present invention have been demonstrated in detail with examples, it should be understood by a person skilled in the art that the above examples are only intended to be illustrative but not to limit the scope of the present invention. It should be understood by a person skilled in the art that the above embodiments can be modified without departing from the scope and spirit of the present invention. The scope of the present invention is defined by the attached claims.

What is claimed is:

1. A multi-mode antenna, comprising:

a CDMA dual-polarized antenna consisting of a plurality of linearly arranged radiation elements and used for receiving and transmitting a radio frequency signal in a CDMA system; and two MIMO dual-polarized antennas each consisting of a plurality of linearly arranged radiation elements and used for receiving and transmitting a radio frequency signal in an LTE system;

wherein one of the two MIMO dual-polarized antennas is stacked in the vertical direction above the centre radiation element of the CDMA dual-polarized antenna and the other of the two MIMO dual-polarized antennas is stacked in the vertical direction below the centre radiation element of the CDMA dual-polarized antenna; and a first set of the radiation elements in the two MIMO dual-polarized antennas are nested in the radiation elements of the CDMA dual-polarized antenna such that a center position of each of the radiation elements in the first set overlaps with a center position of a corresponding radiation element of the CDMA dual-polarized antenna and each of a second set of elements in the two MIMO dual-polarized antennas is disposed between two radiation elements of the CDMA dual-polarized antenna;

the distance between the lowest radiation element in the MIMO dual-polarized antenna right above the centre radiation element of the CDMA dual-polarized antenna and the top radiation element in the MIMO dual-polarized antenna right below the centre radiation element of the CDMA dual-polarized antenna is between $0.7\lambda1$ to $1\lambda1$, wherein, $\lambda1$ is the wavelength of a center frequency supported by the LTE MIMO dual-polarized antenna.

2. The multi-mode antenna according to claim 1, wherein that the CDMA dual-polarized antenna and the two MIMO dual-polarized antennas are all ±45 degrees polarized.

3. The multi-mode antenna according to claim 1, wherein that the CDMA dual-polarized antenna and the two MIMO dual-polarized antennas construct a physical antenna, and are encapsulated into one radome.

4. The multi-mode antenna according to claim 1, wherein that the numbers of radiation elements of the CDMA dual-polarized antenna and the two MIMO dual-polarized antennas are determined by their gains.

5. The multi-mode antenna according to claim 1, wherein the distance between two adjacent radiation elements of the CDMA dual-polarized antenna is between $0.7\lambda2$ to $1\lambda2$, the distance between two adjacent radiation elements of each of the MIMO dual-polarized antennas is between $0.7\lambda1$ to $1\lambda1$, wherein $\lambda2$ is the wavelength of a center frequency supported by the CDMA dual-polarized antenna, $\lambda1$ is the wavelength of a center frequency supported by the LTE MIMO dual-polarized antenna.

6. The multi-mode antenna according to claim 4, wherein that in the case that the number of the radiation elements of the CDMA dual-polarized antenna is an odd, a middle antenna radiation element is taken as a centre radiation element, in the case that the number of the radiation elements of the CDMA dual-polarized antenna is an even, any one of two middle antenna radiation elements is taken as a centre radiation element.

7. The multi-mode antenna according to claim 1, wherein that the CDMA dual-polarized antenna and the two MIMO dual-polarized antennas adopt separate electrical adjustment systems to separately control electrical downtilt angles for the CDMA dual-polarized antenna and the two MIMO dual-polarized antennas.

8. A base station, comprising a multi-mode antenna, wherein the multi-mode antenna comprising:

a CDMA dual-polarized antenna consisting of a plurality of linearly arranged radiation elements and used for receiving and transmitting a radio frequency signal in a CDMA system; and two MIMO dual-polarized antennas each consisting of a plurality of linearly arranged radiation elements and used for receiving and transmitting a radio frequency signal in an LTE system;

wherein one of the two MIMO dual-polarized antennas is stacked in the vertical direction above the centre radiation element of the CDMA dual-polarized antenna and the other of the two MIMO dual-polarized antennas is stacked in the vertical direction right below the centre radiation element of the CDMA dual-polarized antenna; and a first set of the radiation elements in the two MIMO dual-polarized antennas are nested in the radiation elements of the CDMA dual-polarized antenna such that a center position of each of the radiation elements in the first set overlaps with a center position of a corresponding radiation element of the CDMA dual-polarized antenna and each of a second set of elements in the two MIMO dual-polarized antennas are disposed between two radiation elements of the CDMA dual-polarized antenna;

the distance between the lowest radiation element in the MIMO dual-polarized antenna right above the centre radiation element of the CDMA dual-polarized antenna and the top radiation element in the MIMO dual-polarized antenna right below the centre radiation element of the CDMA dual-polarized antenna is between $0.7\lambda1$ to $1\lambda1$, wherein, $\lambda1$ is the wavelength of a center frequency supported by the LTE MIMO dual-polarized antenna.

9. The base station according to claim 8, wherein that the CDMA dual-polarized antenna and the two MIMO dual-polarized antennas are all ±45 degrees polarized.

10. The base station according to claim 8, wherein that the CDMA dual-polarized antenna and the two MIMO dual-polarized antennas construct a physical antenna, and are encapsulated into one radome.

11. The base station according to claim 8, wherein that the numbers of radiation elements of the CDMA dual-polarized antenna and the two MIMO dual-polarized antennas are determined by their gains.

12. The base station according to claim 8, wherein that the distance between two adjacent radiation elements of the CDMA dual-polarized antenna is between $0.7\lambda2$ to $1\lambda2$, the distance between two adjacent radiation elements of each of the MIMO dual-polarized antennas is between $0.7\lambda1$ to $1\lambda1$, wherein $\lambda2$ is the wavelength of a center frequency supported by the CDMA dual-polarized antenna, $\lambda1$ is the wavelength of a center frequency supported by the LTE MIMO dual-polarized antenna.

13. The base station according to claim 8, wherein that in the case that the number of the radiation elements of the CDMA dual-polarized antenna is an odd, a middle antenna radiation element is taken as a centre radiation element, in the case that the number of the radiation elements of the CDMA dual-polarized antenna is an even, any one of two middle antenna radiation elements is taken as a centre radiation element.

14. The base station according to claim 8, wherein that the CDMA dual-polarized antenna and the two MIMO dual-polarized antennas adopt separate electrical adjustment systems to separately control electrical downtilt angles for the CDMA dual-polarized antenna and the two MIMO dual-polarized antennas.

* * * * *